US010061219B2

(12) United States Patent
Kayamori et al.

(10) Patent No.: US 10,061,219 B2
(45) Date of Patent: Aug. 28, 2018

(54) ELECTROSTATIC CHARGE IMAGE DEVELOPING WHITE TONER, MANUFACTURING METHOD THEREOF, IMAGE FORMING APPARATUS, AND IMAGE FORMING METHOD

(71) Applicant: Konica Minolta, Inc., Tokyo (JP)

(72) Inventors: Takanari Kayamori, Kawasaki (JP); Masaharu Matsubara, Hachioji (JP); Naoya Tonegawa, Sagamihara (JP); Kouji Izawa, Tokyo (JP); Atsushi Iioka, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/710,327

(22) Filed: Sep. 20, 2017

(65) Prior Publication Data

US 2018/0088481 A1 Mar. 29, 2018

(30) Foreign Application Priority Data

Sep. 29, 2016 (JP) ..... 2016-190868

(51) Int. Cl.
*G03G 9/097* (2006.01)
*G03G 9/08* (2006.01)
(Continued)

(52) U.S. Cl.
CPC ..... *G03G 9/09716* (2013.01); *G03G 9/0806* (2013.01); *G03G 9/0819* (2013.01);
(Continued)

(58) Field of Classification Search
CPC .... G03G 9/097; G03G 9/09716; G03G 9/087; G03G 9/0819; G03G 9/0806;
(Continued)

(56) References Cited

U.S. PATENT DOCUMENTS 8,828,634 B2 * 9/2014 Sugitate ..... G03G 15/0879 399/252
2012/0148948 A1 * 6/2012 Ikeda ..... G03G 9/09708 430/108.3

FOREIGN PATENT DOCUMENTS

JP 2012128008 A 7/2012
JP 2012154957 A 8/2012
JP 2013109097 A 6/2013

OTHER PUBLICATIONS

The Extended European Search Report, 17194110.7, dated Dec. 5, 2017.

* cited by examiner

*Primary Examiner* — Hoa V Le
(74) *Attorney, Agent, or Firm* — Lucas & Mercanti, LLP

(57) ABSTRACT

An electrostatic charge image developing white toner according to the present invention includes toner base particles including rutile type titanium oxide particles as colorant and a binder resin. The rutile type titanium oxide particles are composed of two groups Ga and Gb of rutile type titanium oxide particles have different volume particle size distribution. A volume particle size distribution curve of the rutile type titanium oxide particles represents diameter on a horizontal axis and volume ratio on a vertical axis and has two main peaks. Diameters Da and Db of peak top positions of the two main peaks are respectively within a range of 100 to 500 nm, and satisfy following Relational expressions:

(Relational expression 1): $25\ \text{nm} \leq Db - Da \leq 200\ \text{nm}$ (Relational expression 2):(mass of *Ga*):(mass of *Gb*)=5:95 to 30:70.

9 Claims, 2 Drawing Sheets

(51) Int. Cl.

| | |
|---|---|
| ***G03G 9/083*** | (2006.01) |
| ***G03G 9/09*** | (2006.01) |
| *G03G 9/087* | (2006.01) |

(52) U.S. Cl.
CPC ..... *G03G 9/0832* (2013.01); *G03G 9/0833* (2013.01); *G03G 9/0902* (2013.01); *G03G 9/0926* (2013.01); *G03G 9/0823* (2013.01); *G03G 9/0827* (2013.01); *G03G 9/08722* (2013.01); *G03G 9/08755* (2013.01); *G03G 9/08782* (2013.01); *G03G 9/09725* (2013.01)

(58) Field of Classification Search
CPC ..... G03G 9/08782; G03G 9/0833; G03G 9/09725; G03G 9/0823; G03G 9/083
See application file for complete search history.

ELECTROSTATIC CHARGE IMAGE DEVELOPING WHITE TONER, MANUFACTURING METHOD THEREOF, IMAGE FORMING APPARATUS, AND IMAGE FORMING METHOD

CROSS-REFERENCE TO RELATED APPLICATIONS

Japanese Patent Application No. 2016-190868 filed on Sep. 29, 2016 including the description, claims, drawings, and abstract the entire disclosure is incorporated by reference in its entirety.

BACKGROUND

Technological Field

The present invention relates to an electrostatic charge image developing white toner, a manufacturing method thereof, an image forming apparatus, and an image forming method. More specifically, the present invention relates to an electrostatic charge image developing white toner and the like having hiding property, hue, and transfer property and complying with the demand in the market of production printing.

Description of the Related Art

With the recent spread of application of electrophotographic technology, the demand for enhancing expressiveness is enhanced, for example, by color printing not only on white paper but on colored paper, by printing on a film, a transparent sheet such as OHP sheet, and a label. An electrostatic charge image developing white toner (hereinafter also referred to as "white toner" or simply as "toner") may be used as an undercoat for clear color development in printing on such medium or as an overcoat which functions as an light reflection layer on a reverse image formed on the film.

White toner image requires excellent hiding property in order to sufficiently function as an undercoat layer. Here, the hiding property means the invisibility of the reverse side from the front side through the white toner image. In order to obtain completely white toner image, all the incident light on the white toner image is required to be scattered and reflected.

For example, Japanese Patent Application Laid-Open Publication No. 2013-109097 discloses a technique to suppress the aggregation of titanium oxide particles by adding a certain amount of titanium oxide particles having specific diameter and thereby to improve the scattering property of titanium oxide particles in the mixture of toner materials. According to the technique of Japanese Patent Application Laid-Open Publication No. 2013-109097, the titanium oxide particles uniformly scattered in a toner particle makes uniform thermal conductivity and suppresses local overheating in the toner particle, and thereby improves high-temperature offset resistivity, prevents local leak of charge, and suppresses transfer omission.

Japanese Patent Application Laid-Open Publication No. 2012-154957 discloses specifying the ratio of rutile type titanium oxide and anatase type titanium oxide to provide a toner that can suppress reduced image storage performance due to discoloration.

Japanese Patent Application Laid-Open Publication No. 2012-128008 discloses a toner containing a binder resin and at least two or more white pigments, which includes a porous titanium oxide in order to adjust hue.

However, whiteness (hiding property), hue, and transfer property are not sufficient according to the white toner described in Japanese Patent Application Laid-Open Publication Nos. 2013-109097, 2012-154957, or 2012-128008. They cannot accelerate image formation or enhance the image quality of obtained visible images to comply with the demand in the market of production printing.

SUMMARY

An object of the present invention, which has been accomplished to solve the problem described above, is to provide an electrostatic charge image developing white toner and the like having hiding property, hue, and transferability complying with the demand in the market of production printing.

The present inventors have examined the causes of the above mentioned problems in order to solve the above problems and arrived at the present invention on the basis of the finding that white toner having good hiding property, hue, and transfer property can be provided by using two groups of rutile type titanium oxide particles, when a volume particle size distribution is different from each other and satisfies specific relations.

To achieve at least one of the above-mentioned objects, according to an aspect of the present invention, an electrostatic charge image developing white toner includes a toner base particles including rutile type titanium oxide particles as colorant and a binder resin, wherein the rutile type titanium oxide particles are composed of two groups Ga and Gb of rutile type titanium oxide particles having different volume particle size distribution, and a volume particle size distribution curve of the rutile type titanium oxide particles represents diameter on a horizontal axis and volume ratio on a vertical axis and has two main peaks, wherein diameters Da and Db of peak top positions of the two main peaks are respectively within a range of 100 to 500 nm, and satisfy the following Relational expressions:

(Relational expression 1): $25\ \text{nm} \leq Db - Da \leq 200\ \text{nm}$ (Relational expression 2): (mass of $Ga$):(mass of $Gb$)=5:95 to 30:70

According to another aspect of the present invention, a manufacturing method of the electrostatic charge image developing white toner includes:

a step of preparing a dispersion liquid of the binder resin, a dispersion liquid of the group Ga of rutile type titanium oxide particles, and a dispersion liquid of the group Gb of rutile type titanium oxide particles; and a step of aggregating and fusing the hinder resin, the group Ga of rutile type titanium oxide particles, and the group Gb of rutile type titanium oxide particles.

According to another aspect of the present invention, an image forming apparatus includes a charger, an electrostatic charge image former, a developer, a transferring unit, and a fixer, wherein the developer forms a toner image by developing an electrostatic charge image using a developing agent for electrostatic charge image development including the electrostatic charge image developing white toner according to the present invention.

According to another aspect of the present invention, an image forming method includes forming a latent image; developing; transferring; fixing; and uses the electrostatic charge image developing white toner according to the present invention and an electrostatic charge image developing colored toner including colorant exhibiting a color other than white.

BRIEF DESCRIPTION OF THE DRAWING

The advantages and features provided by one or more embodiments of the invention will become more fully understand from the detailed description given hereinbelow and the appended drawings which are given by way of illustration only, and thus are not intended as a definition of the limits of the present invention.

DETAILED DESCRIPTION OF EMBODIMENTS

Figure 1:
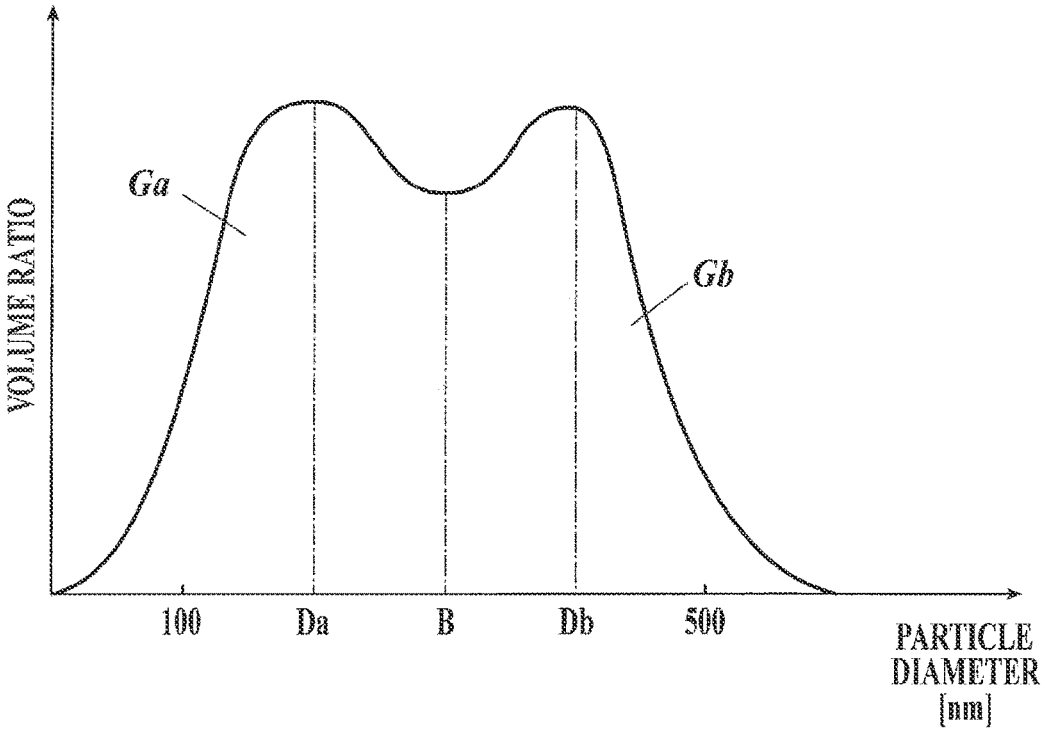
FIG. 1 is a schematic diagram of an exemplary volume particle size distribution curve of rutile type titanium oxide particle according to the present invention.

Hereinafter, one or more embodiments of the present invention will be described with reference to the drawings. However, the scope of the invention is not limited to the disclosed embodiments.

Two kinds of titanium oxide used are mainly known as a white pigment, one having a rutile type crystalline structure and another having an anatase type crystalline structure titanium oxide. The rutile type titanium oxide has higher refractive index than the anatase type titanium oxide. Higher refractive provides higher hiding power by enhancing efficiency of reflecting and scattering light at the interface of the resin and the titanium oxide. Furthermore, the rutile type titanium oxide has less oxidation effect as a photocatalyst and results in less chalking and excellent light resistance.

For obtaining high hiding power, the rutile type titanium oxide particles (hereinafter, simply referred to as "titanium oxide particles") preferably have a diameter that provides the maximum light scattering property of visible light. Specifically, the main peaks of the volume particle size distribution curve (horizontal axis: particle diameter, vertical axis: volume ratio) of the rutile type titanium oxide particles have peak tops at a position corresponding to diameters within the range of 100 to 500 nm, more preferably 200 to 300 nm. The shape of the titanium oxide particles may be spherical shape, needle shape, spindle shape, and the like. In the present invention, spherical shape is preferred from the viewpoint of improving hiding rate.

Furthermore, it is necessary to increase the mass of the titanium oxide contained in the toner base particles for improving hiding power.

When mass (content) of the titanium oxide particles contained in the toner base particles is small, titanium oxide particles having a smaller diameter improves higher hiding power because of the large surface area for scattering light.

However, as the content of titanium oxide particles having a small diameter is increased, hiding power starts to be reduced (crowding effect) at a certain level. Titanium oxide particles having a small diameter easily cause the crowding effect and largely reduce the hiding power. The hiding power starts to be improved again when the content is larger than the level that causes the crowding effect. Titanium oxide particles having a large diameter with small crowding effect can provide larger hiding power compared to those having a small diameter when the content (mass) is very large. However, the resistance and transfer property of the toner are reduced by filling only the titanium oxide particles having a large diameter with high concentration. The titanium oxide particles having a large diameter cannot function effectively when content is too small. According to the present invention, the transfer property is considered to be improved by using two groups of titanium oxide particles having different diameters in combination.

The present inventors considered that, by using two groups of titanium oxide particles having different diameters in combination, the content can be adjusted to the value at which the hiding power is the maximum without causing the crowding effect. It is considered that the hiding power can be improved with lower parts of titanium oxide according to the present invention compared to the case in which one group of titanium oxide particles are densely filled.

As a result of intensive studies, the present inventors arrived at the present invention based on the finding that when the diameters of the peak-top position of the two main peaks are respectively referred to as Da and Db in a volume particle size distribution curve of the two groups of rutile type titanium oxide particles, it is preferred that the Da and Db are respectively within the range of 100 to 500 am and satisfy the following Relational expressions:

(Diameter difference: Relational expression 1): $25\ \text{nm} \leq Db - Da \leq 200\ \text{nm}$ (Filling ratio: Relational expression 2): (mass of $Ga$):(mass of $Gb$)=5:95 to 30:70

Because the rutile type titanium oxide highly absorbs light at a wavelength of near 400 nm and slightly tinged in yellow, a complementary color, the hue of the rutile type titanium oxide is slightly yellowish compared to that of the anatase type titanium oxide. Meanwhile, the hue becomes bluish as the volume average particle diameter becomes small. According to the present invention, the hue can also be improved by adding smaller titanium oxide particles having Da and Db within the range of 100 to 500 nm.

The electrostatic charge image developing white toner according to the present invention includes toner base particles including rutile type titanium oxide particles as colorant and a binder resin. The rutile type titanium oxide particles are composed of two groups (Ga and Gb) of rutile type titanium oxide particles having different volume particle size distribution. A volume particle size distribution curve (horizontal axis: diameter, vertical axis: volume ratio) of the rutile type titanium oxide particles has two main peaks. The diameters Da and Db of peak top positions of the two main peaks are respectively within the range of 100 to 500 nm and satisfy the above Relational expression 1 and Relational expression 2. They are technical features common to or corresponding to the present invention. According to these technical features, the present invention can provide an electrostatic charge image developing white toner and the like having hiding property, hue, and transfer property complying with the demand in the market of production printing.

In a preferred embodiment of the present invention, total mass of the two groups (Ga and Gb) of rutile type titanium oxide particles are within a range of 20 to 60 mass % relative to 100 mass % of the binder resin. Hiding property, hue, and transfer property can be thereby improved.

In another preferred embodiment of the present invention, the diameters Da and Db of the peak top position are respectively within the range of 200 to 300 nm. Hiding property, hue, and transfer property can be thereby improved.

In another preferred embodiment of the present invention, the diameters Da and Db of the peak top positions satisfy the following Relational expression 3. Hiding property, hue, and transfer property can be thereby improved.

(Relational expression 3): $20\ \text{nm} \leq Db - Da \leq 100\ \text{nm}$

In another preferred embodiment of the present invention, a vinyl resin is included as the binder resin. Transfer property can be thereby improved.

In a preferred embodiment of the present invention, a manufacturing method of the electrostatic charge image developing white toner according to the present invention includes the following steps. A step of preparing a dispersion liquid of the binder resin, a dispersion liquid of the group Ga of rutile type titanium oxide particles, and a dispersion liquid of the group Gb of rutile type titanium oxide particles, and a step of aggregating and fusing the binder resin, the group Ga of rutile type titanium oxide particles, and the group Gb of rutile type titanium oxide particles. An electrostatic charge image developing white toner having good hiding property, hue, and transfer property can be thereby manufactured.

In a preferred embodiment of the present invention, an image forming apparatus using the electrostatic charge image developing white toner according to the present invention includes a charger, an electrostatic charge image former, a developer, a transferring unit, and a fixer. The developer preferably forms a toner image by developing an electrostatic charge image using a developing agent for electrostatic charge image development including the electrostatic charge image developing white toner according to the present invention. An image having good hiding property, hue, and transfer property can be thereby formed.

In another preferred embodiment of the present invention, an image forming apparatus using the electrostatic charge image developing white toner according to the present invention includes five or more electrostatic charge image formers and five or more developers. A full color image can be thereby formed with white color having hiding property, hue, and transfer property that comply with the demand in the market of production printing.

In a preferred embodiment of the present invention, the image forming method using the electrostatic charge image developing white toner according to the present invention includes forming a latent image, developing, transferring, and fixing. In the embodiment, the electrostatic charge image developing white toner according to the present invention and an electrostatic charge image developing colored toner including colorant exhibiting a color other than white are preferably used. A method for forming a color image having good hiding property, hue, and transfer property can be thereby provided.

The present invention and its constituent and embodiments for achieving the present invention will now be described in detail. Throughout the specification, "to" between two numerical values indicates that the lower limit includes the numeric value before "to" and that the upper limit includes the numeric value after "to".

<<Summary of Electrostatic Charge Image Developing White Toner>>

The electrostatic charge image developing white toner according to the present invention includes toner base particles including rutile type titanium oxide particles as colorant and a binder resin. The rutile type titanium oxide particles are composed of two groups (Ga and Gb) of rutile type titanium oxide particles having different volume particle size distribution. The volume particle size distribution curve (horizontal axis: particle diameter, vertical axis: volume ratio) of the rutile type titanium oxide particles have two main peaks, and the diameters Da and Db of the peak top positions of the two main peaks are respectively within the range of 100 to 500 nm and satisfy the above Relational expression 1 and Relational expression 2.

A "toner" means an assembly of "toner particles" in the present invention.

[Toner Base Particle]

The toner base particles according to the present invention include rutile type titanium oxide particles as colorant and a binder resin.

The toner base particles according to the present invention can be used as toner particles as they are, however, the toner base particles with an external additive are preferably used as toner particles.

[Colorant]

The toner base particles according to the present invention include rutile type titanium oxide particles as colorant.

<Rutile Type Titanium Oxide Particle>

The rutile type titanium oxide (hereinafter, also simply referred to as "titanium oxide") particles are composed of two groups (Ga and Gb) of rutile type titanium oxide particles having different volume particle size distribution from each other. The volume particle size distribution curve (horizontal axis: diameter, vertical axis: volume ratio) of the rutile type titanium oxide particles has two main peaks. The diameters (Da and Db) of the peak top positions of the two main peaks are respectively within the range of 100 to 500 nm and satisfy the following Relational expressions 1 and 2:

(Relational expression 1): $25\ \text{nm} \leq Db - Da \leq 200\ \text{nm}$ (Relational expression 2): (mass of $Ga$):(mass of $Gb$)=5:95 to 30:70

Preferably, in the volume particle size distribution curve of the rutile type titanium oxide particle, Da and Db (diameters of peak top positions of two main peaks in volume particle size distribution curve) are respectively within the range of 200 to 300 nm from the viewpoint of improving hiding property, hue, and transfer property.

Preferably, total mass of the two groups (Ga and Gb) of rutile type titanium oxide particles are within a range of 20 to 60 mass % relative to 100 mass % of the binder resin, from the viewpoint of improving hiding property, hue, and transfer property.

Preferably, Da and Db (diameters of peak top positions of two main peaks in volume particle size distribution curve) satisfy the following Relational expression 3, from the viewpoint of improving hiding property, hue, and transfer property.

(Relational expression 3): $20\ \text{nm} \leq Db - Da \leq 100\ \text{nm}$

When the two groups of the rutile type titanium oxide particles are almost equivalent in content, the diameter range which causes crowding effect can be prevented from overlapping by making the diameters Da and Db of the peak top position respectively within the range of 100 to 500 nm and (Da−Db) 25 nm or more. As a result, reduction in hiding rate can be suppressed. Furthermore, when (Da−Db) is 100 nm or less, reduction in hiding rate due to crowding effect can be further suppressed and the titanium oxide particles can be uniformly captured in the toner resin. As a result, transfer property is further improved.

The rutile type titanium oxide is prepared using ilmenite as a starting material. Meta-titanic acid slurry is prepared by hydrolysis of the dispersion liquid obtained by decomposition of ilmenite with sulfuric acid. After adjusting the pH of the meta-titanic acid slurry, titanium oxide is obtained by filtration, calcination, and crushing. The obtained titanium oxide is dispersed in a solution and mixed and reacted with hydrophobic agent added dropwise. The rutile type titanium oxide is obtained by filtration, calcination, and crushing of the solution.

The volume particle size distribution curve of the rutile type titanium oxide particle represents diameter on a horizontal axis and volume ratio on a vertical axis and is prepared on the basis of the primary diameter of randomly-selected 100 particles measured with a transmission type electron microscope. In the volume particle size distribution curve, the maximum point of the peak is determined as a "peak top". Primary diameter does not refer to the diameter of the aggregate but the diameter of a particle which is not aggregated.

The "main peaks" according to the present invention refer to the peaks having the first and the second maximum intensity (value of the vertical axis) among the peaks within 100 run to 500 nm in the obtained volume particle size distribution curve.

The volume particle size distribution curve of the titanium oxide particles included in a manufactured toner can be prepared by the same measurement method described above, by extracting the titanium oxide particles through elution of toner resin from tetrahydrofuran (THF). When there are two main peaks of diameter as in FIG. 1, two groups (Ga and Gb) of rutile type titanium oxide particles are determined by separation with the border line (B) between the main peaks. The area ratio of Ga and Gb is thereby calculated. The border line is determined by the diameter corresponding to the minimum intensity (value of the vertical axis) between the main peaks. The area ratio of Ga and Gb can be converted into volume ratio of Ga and Gb. Because volume is proportional to and can be converted into mass using specific gravity, the volume ratio of Ga and Gb corresponds to the mass ratio of Ga and Gb. Accordingly, the mass ratio of Ga and Gb described in Relational expression 2 can be calculated from a manufactured toner.

The crystal structure of the titanium oxide in the toner can be observed using raman spectroscopic apparatus.

In the present embodiment, the titanium oxide particles may be used after modifying the surface with other compound (hereinafter may be referred to as "surface modification"). Surface modification includes modifying the surface with oxide hydrate of $Al_2O_3$, $SiO_2$, $ZrO_2$, and the like, and doping a small amount of different metal such as Al and Zn on the titanium oxide crystal lattice. Furthermore, the surface-modified titanium oxide may be treated with a coupling agent and the like.

Surface modifier is not particularly limited, and examples of surface modifier include silane coupling agent. Surface modifier may be used alone or in combination of two or more. Surface modification can be performed, for example, by immersion of the titanium oxide particles to the surface modifier.

Examples of the silane coupling agent include special silylating agents. More specific examples of the silane coupling agent include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bis trimethylsilyl) acetamide, N,N-(trimethylsilyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane, and γ-chloropropyltrimethoxysilane.

Within a range not inhibiting the advantageous effects may be used inorganic pigments (heavy calcium carbonate, light calcium carbonate, titanium dioxide, aluminum hydroxide, satin white, talc, calcium sulfate, barium sulfate, zinc oxide, magnesium oxide, magnesium carbonate, amorphous silica, colloidal silica, white carbon, kaolin, calcined kaolin, delaminated kaolin, aluminosilicate, sericite, bentonite, smectite, etc.); organic pigments (polystyrene resin particles, urea formalin resin particles, etc.); and pigments having a hollow structure (hollow resin particles and hollow silica). They may be used alone or in combination of two or more.

[Binder Resin]

As a binder resin, vinyl resins are preferably included for improving transfer property.

Other than vinyl resins, crystalline polyester resins and amorphous polyester resins may be included as a binder resin.

<Vinyl Resin>

A resin formed by polymerization of one or more kinds of the vinyl monomers, such as styrene monomers described below, can be used as a vinyl resin.

(1) Styrene Monomers

Styrene, o-methylstyrene, m-methylstyrene, p-methylstyrene, α-methylstyrene, p-chlorostyrene, 3,4-dichlorostyrene, p-phenylstyrene, p-ethylstyrene, 2,4-dimethylstyrene, p-t-butylstyrene, p-n-hexylstyrene, p-n-octylstyrene, p-n-nonylstyrene, p-n-decylstyrene, p-n-dodecylstyrene, and derivatives of these monomers (2) (Meth)acrylic Acid Ester Monomers Methyl (meth)acrylate, ethyl (meth)acrylate, n-butyl (meth)acrylate, iso-propyl (meth)acrylate, iso-butyl (meth) acrylate, t-butyl (meth)acrylate, n-octyl (meth)acrylate, 2-ethylhexyl (meth)acrylate, stearyl (meth)acrylate, lauryl (meth)acrylate, phenyl (meth)acrylate, diethylaminoethyl (meth)acrylate and dimethylaminoethyl (meth)acrylate, and derivatives of these monomers (3) Vinyl Esters Vinyl propionate, vinyl acetate, and vinyl benzoate (4) Vinyl Ethers Vinyl methyl ether and vinyl ethyl ether (5) Vinyl Ketones Vinyl methyl ketone, vinyl ethyl ketone and vinyl hexyl ketone (6) N-Vinyl Compounds N-vinyl carbazole, N-vinyl indole, and N-vinyl pyrrolidone (7) Others Vinyl compounds such as vinylnaphthalene and vinylpyridine; acrylic acid or methacrylic acid derivatives such as acrylonitrile, methacrylonitrile, and acrylamide It is preferable to use vinyl monomers containing ionic-dissociative group such as a carboxy group, a sulfonic acid group or a phosphoric acid group. Specific examples are as follows.

Examples of a monomer containing a carboxy group are: acrylic acid, methacrylic acid, maleic acid, itaconic acid, cinnamic acid, fumaric acid, monoalkyl maleate, and monoalkyl itaconate. Examples of a monomer containing a sulfonic acid group are: styrenesulfonic acid, allylsulfosuccinic acid, and 2-acrylamido-2-methylpropanesulfonic acid. An example of a monomer containing a phosphoric acid group is acid phosphooxyethyl methacrylate.

Furthermore, by using poly-functional vinyl compounds as vinyl monomers, the vinyl polymer may be changed into a cross-linked resin. Examples of a poly-functional vinyl compound include: divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentylglycol dimethacrylate, and neopentylglycol diacrylate.

The vinyl resin may be prepared by polymerization through any known polymerization technique, such as bulk polymerization, solution polymerization, emulsion polymerization, miniemulsion polymerization, or dispersion polymerization, and prepared by using any polymerization initiator typically used in polymerization of the above monomers can be used, for example, a peroxide, persulfide, persulfate, or azo compound.

<Polyester Resin>

The polyester resin includes any known polyester resin obtained by polycondensation reaction of a di- or more carboxylic acid component (hereinafter, also simply referred to as "polycarboxylic acid component") and a di- or more alcohol component (hereinafter, also simply referred to as "polyalcohol component").

(Polycarboxylic Acid)

Unsaturated aliphatic polycarboxylic acids, aromatic polycarboxylic acids, and the derivatives thereof are preferably used. As long as an amorphous resin can be formed, saturated aliphatic polycarboxylic acids may also be used in combination. Examples of unsaturated aliphatic polycarboxylic acids include methylene succinic acid, fumaric acid, maleic acid, 3-hexenedioic acid, 3-octenedioic acid, unsaturated aliphatic dicarboxylic acids such as succinic acid substituted with an alkyl group of 1 to 20 carbon atoms or alkenyl group of 2 to 20 carbon atoms, 3-butene-1,2,3-tricarboxylic acid, 4-pentene-1,2,4-tricarboxylic acid, unsaturated aliphatic tricarboxylic acids such as aconitic acid, unsaturated aliphatic tetracarboxylic acids such as 4-pentene-1,2,3,4-tetracarboxylic acid, and the like. Further, lower alkyl esters and anhydrides of these compounds can also be used.

Specific examples of succinic acid that is substituted with an alkyl group of 1 to 20 carbon atoms or an alkenyl group of 2 to 20 carbon atoms include dodecyl succinic acid, dodecenyl succinic acid, octenyl succinic acid and the like. Further, lower alkyl esters and anhydrides of these compounds can also be used. Examples of aromatic polycarboxylic acids include aromatic dicarboxylic acids such as phthalic acid, terephthalic acid, isophthalic acid, t-butylisophthalic acid, tetrachlorophthalic acid, chlorophthalic acid, nitrophthalic acid, p-phenylenediacetic acid, 2,6-naphthalenedicarboxylic acid, 4,4'-biphenyldicarboxylic acid andanthracene dicarboxylic acid; aromatic tricarboxylic acids such as 1,2,4-benzenetricarboxylic acid (trimellitic acid), 1,2,5-benzenetricarboxylic acid (trimesic acid), 1,2,4-naphthalenetricarboxylic acid and hemimellitic acid; aromatic tetracarboxylic acids such as pyromellitic acid and 1,2,3,4-butanetetracarboxylic acid; aromatic hexacarboxylic acids such as mellitic acid, and the like. Further, lower alkyl esters and anhydrides of these compounds can be used.

Examples of saturated aliphatic polycarboxylic acids are desirably aliphatic dicarboxylic acids, particularly straight chain carboxylic acids. Examples of such straight chain carboxylic acids include oxalic acid, malonic acid, succinic acid, glutaric acid, adipic acid, pimelic acid, suberic acid, azelaic acid, sebacic acid, 1,9-nonane dicarboxylic acid, 1,10-decane dicarboxylic acid, 1,11-undecane dicarboxylic acid, 1,12-dodecane dicarboxylic acid, 1,13-tridecane dicarboxylic acid, 1,14-tetradecane dicarboxylic acid, 1,18-octadecane dicarboxylic acid, 1,20-eicosane dicarboxylic acid, and the lower alkyl esters thereof and the anhydrides thereof. They can be used alone or in combination of two or more.

The number of carbon atoms of the dicarboxylic acids is not particularly limited. However, from the viewpoint of easy optimization of thermal properties, the number of carbon atoms is preferably within the range of 1 to 20, more preferably within the range of 2 to 15, particularly within the range of 3 to 12. The dicarboxylic acid component is not limited to a single compound and may be a mixture of two or more compounds.

The number of carbon atoms in the tri- or more carboxylic acids is not particularly limited. However, in terms of ease of optimization of the thermal properties, the number of carbon atoms is preferably within the range of 3 to 20, more preferably within the range of 5 to 15, particularly within the range of 6 to 12. The polycarboxylic acid component is not limited to a single compound and may be a mixture of two or more compounds.

(Polyalcohol)

In terms of the charge characteristic and the strength of the toner, preferred polyalcohols that can be used in the present invention are unsaturated aliphatic polyalcohols, aromatic polyalcohols and the derivatives thereof. As long as the amorphous polyester resin can be formed, saturated aliphatic alcohols may also be used in combination.

Examples of unsaturated aliphatic polyalcohols include unsaturated aliphatic diols such as 2-butene-1,4-diol, 3-butene-1,4-diol, 2-butyne-1,4-diol, 3-butyne-1,4-diol and 9-octadecene-7, 2-diol; glycerin, trimethylolpropane, pentaerythritol, sorbitol and the like. Further, derivatives of these compounds can also be used.

Examples of aromatic polyalcohols include bisphenols such as bisphenol A and bisphenol F; alkylene oxide adducts of the bisphenols such as ethylene oxide adducts and propylene oxide adducts; 1,3,5-benzenetriol, 1,2,4-benzenetriol, 1,3,5-trihydroxymethylbenzene and the like. Further, derivatives of these compounds can also be used. Among them, bisphenol A-based compounds such as ethylene oxide adduct and propylene oxide adduct of bisphenol A are preferably used in terms of particularly improving the charge uniformity and ease of optimization of the thermal properties of the toner.

The polyalcohol component is not limited to a single compound and may be a mixture of two or more compounds. The number of carbon atoms in tri- or more alcohols is not particularly limited. However, in terms of ease of optimization of the thermal properties, the number of carbon atoms are preferably from 3 to 20.

Here, an amorphous polyester resins is a polyester resin having an amorphous property, which designates a property of indicating a glass transition point (Tg) in an endothermic curve obtained by measurement with differential scanning calorimetry (DSC), but not indicating a clear endothermic peak of a melting point during the temperature rising step. Here, "a clear endothermic peak" designates an endothermic peak having a half bandwidth within 15° C. in an endothermic curve obtained under the condition of a temperature raising rate of 10° C./min.

A crystalline polyester resin is a polyester resin having a crystalline property. Here, "a crystalline property" designates a property of indicating a clear endothermic peak of a melting point during the temperature rising step in an endothermic curve obtained by measurement with DSC.

[Releasing Agent]

Examples of releasing agents that can be used include hydrocarbon waxes such as polyethylene wax, polypropylene wax, polybutene wax and paraffin wax; silicones that exhibits a softening point when heated; fatty acid amides such as oleic acid amide, erucamide, ricinolic acid amide and stearic acid amide; vegetable waxes such as carnauba wax, rice wax, candelilla wax, wood wax and jojoba oil; animal waxes such as bee wax; ester waxes such as fatty acid esters and montanic acid esters; mineral/petroleum waxes such as montan wax, ozocerite, ceresin, microcrystalline wax and Fischer-Tropsch wax; modified products of thereof; and the like.

Among them, waxes with low melting point, specifically within the range of 60° C. to 85° C., are preferably used in terms of the releasability in low-temperature fixing. The percentage of the releasing agent in toner base particles is preferably within the range of 1 to 20 mass %, more preferably within the range of 5 to 15 mass %.

[Charge Controlling Agent]

The toner particles according to the present invention may include a charge controlling agent, if necessary. The charge controlling agent is not particularly limited and any known compound can be used.

[External Additive]

The white toner according to the present invention may contain particles of an external additive.

External additive particles known in the art may be used. Examples of such external additive particles include inorganic oxide fine particles such as silica fine particles, alumina fine particles and titania fine particles; inorganic stearate compound fine particles such as aluminum stearate fine particles and zinc stearate fine particles; inorganic titanate compound fine particles such as strontium titanate and zinc titanate; and the like. They may be used alone or in combination of two or more. It is preferred that a gloss treatment with a silane coupling agent, a titanium coupling agent, a higher fatty acid or a silicone oil is given to these inorganic fine particles in order to improve the thermal storage stability and the environmental stability.

Organic fine particles may also be used as external additive particles. Organic fine particles that can be used are spherical organic particles having a number average primary particle size of approximately from 10 to 2000 nm. Specifically, organic fine particles of homopolymers such as styrene and methylmethacrylate and copolymers thereof can be used.

Lubricants may also be used as an external additive. Lubricants are used for the purpose of improving the cleaning property and the transferring property. Specific examples thereof include metal salts of higher fatty acids such as stearates of zinc, aluminum, copper, magnesium, calcium and the like, oleates of zinc, manganese, iron, copper, magnesium and the like, palmitates of zinc, copper, magnesium, calcium and the like, linoleates of zinc, calcium and the like, ricinoleates of zinc, calcium and the like, and the like.

These external additives may be used in a variety of combinations.

The amount of external additive added is preferably within the range of 0.1 to 10.0 parts by mass with respect to 100 parts by mass of the toner particles. The external additive may be added by using any of a variety of mixing machines known in the art such as a turbuler mixer, a Henschel mixer, a nauta mixer or a V-shaped mixer

[Particle Diameter of Toner Particle]

The volume-based median diameter of the toner particles according to the present invention is preferably 3 μm to 8 μm, more preferably 5 μm to 8 μm. The median diameter can be controlled in manufacturing by controlling the concentration of aggregation agent, amount of added organic solvent, fusion time, composition of the binder resin, and the like. The volume-based median diameter within above range can faithfully reproduce an extremely minute dot image of 1200 dpi.

The volume-based median diameter of the toner particles is measured and calculated with a measuring device "MULTISIZER-3" (Beckman Coulter Corp.) connected to a computer system with a data processing software "Software V3.51". Specifically, 20 mL of surfactant solution (for the purpose of dispersing toner particles, e.g. neutral detergent containing a surfactant component, diluted by 10 times with pure water) is added to 0.02 g of toner particles and mixed. Thereafter, the solution is subjected to ultrasonic dispersion for 1 minute so that toner particle dispersion is prepared. By using a pipette, the toner particle dispersion is added to "ISOTON II" (Beckman Coulter Corp.) in a beaker set in a sample stand until the concentration displayed on the measuring device reaches 8%. At this concentration, it is possible to obtain a reproducible measurement value. The particle count and the aperture diameter of the measuring device are respectively set to 25000 and 50 μm. The measurement range of 1 μm to 30 μm is divided into 256 sections, and the frequency values of the respective sections are calculated. The volume-based median diameter is defined as the particle diameter where the percentage of cumulative volume of the larger particles reaches 50%.

(Average Circularity of Toner Particles)

In the toner of the present invention, it is preferred that the average circularity of the toner particles of the toner is within the range of 0.920 to 1.000, more preferably within the range of 0.920 to 0.995 in terms of the stability of the charge characteristic and the low-temperature fixability. When the average circularity falls within this range, the individual toner particles are less crushable. This prevents the triboelectric charging member from smudges and stabilizes the charge characteristic of the toners. Further, high quality images can be formed. The average circularity of the toner particles is measured with an "FPIA-2100" (Sysmex Corp.). Specifically, a measurement sample (toner particles) is mixed with an aqueous solution containing a surfactant and is further subjected to ultrasonic dispersion for 1 minute. Thereafter, photographs are taken with the "FPIA-2100" (Sysmex Corp.) in the measurement conditions of the HPF (high power photographing) mode at an adequate concentration corresponding to a number of HPF detection of 3000 to 10000. The average circularity of the toner is calculated by determining the circularity of individual toner particles according to the following Equation and dividing the sum of circularities of the individual toners by the total number of toner particles. When the number of HPF detection is within this range, the result is reproducible.

Circularity=(Circumference of circle having same area as projected image of particle)/(Perimeter of projected image of particle)

<<Developing Agent for Electrostatic Charge Image Development>>

The toner of the present invention may be used as a magnetic or nonmagnetic one-component developer or as a two-component developer by being mixed with a carrier. When used as a two-component developer, examples of carriers that can be used include magnetic particles known in the art that are made of metals such as iron, ferrite and magnetite, alloys of these metals with another metal such as aluminum and lead, and the like. Among them, ferrite particles are preferably used. Further, carriers that can also be used include coated carriers, in which the surface of magnetic particles is covered with a coating agent such as a resin, and dispersed carriers, in which magnetic fine powder is dispersed in a binder resin.

It is preferred that the volume-based median diameter of the carrier is preferably within the range of 15 μm to 100 μm, more preferably within the range of 25 μm to 60 μm. The volume-based median diameter of the carrier can be measured typically with a laser diffraction particle size measuring device "HELOS" (Sympatecs GmbH) equipped with a wet disperser.

<<Manufacturing Method of Electrostatic Charge Image Developing White Toner>>

The manufacturing method of electrostatic charge image developing white toner according to the present invention is not particularly limited, but preferably includes a step of preparing a dispersion liquid of the binder rein, a dispersion liquid of the group Ga of rutile type titanium oxide particles, and a dispersion liquid of the group Gb of rutile type titanium oxide particles and a step of aggregating and fusing the binder resin, the group Ga of rutile type titanium oxide particles, and the group Gb of rutile type titanium oxide particles.

Hereinafter, an exemplary manufacturing method of toner (toner particle) according to the present invention will be described.

[Manufacturing Method of Toner Particle]

The toner particles used in the present invention includes toner base particles including rutile type titanium oxide particles as colorant and a binder resin.

The manufacturing method of the toner particles is not particularly limited, and known manufacturing method can be used. For example, the toner particles can be prepared by a method of manufacturing grinded toner (grind method) through steps of kneading, grinding, and classification and by a polymerization method of manufacturing toner by forming particles through polymerization of polymerizable monomers while controlling the shape and size (for example, emulsion polymerization method, a suspension polymerization method, and a polyester elongation method). In particular, as described above, the manufacturing method preferably includes a step of preparing a dispersion liquid of the binder resin, a dispersion liquid of the group Ga of rutile type titanium oxide particles, and a dispersion liquid of the group Gb of rutile type titanium oxide particles and a step of aggregating and fusing the binder resin, the group Ga of rutile type titanium oxide particles, and the group Gb of rutile type titanium oxide particles. It can be said that one of the effective manufacturing method is an emulsion association method, which includes a step of aggregating the resin particles having a diameter of about 120 nm prepared by emulsion polymerization method or a suspension polymerization method.

Hereinafter, an exemplary manufacturing method of toner particles by an emulsion association method will be described. The steps of emulsion association method to prepare toner particles are summarized as follows:

(1) Step of preparing dispersion liquids (1-1) Step of preparing a dispersion liquid of resin particles (1-2) Step of preparing a dispersion liquid of colorant particles (2) Step of aggregating and fusing resin particles (3) Aging step (4) Cooling step (5) Washing step (6) Drying step (7) Step of treating with external additive (according to necessity)

Hereinafter, each step is described.

(1) Step of Preparing Dispersion Liquids

In the step of preparing dispersion liquids, a dispersion liquid of the binder resin, a dispersion liquid of the group Ga of rutile type titanium oxide particles, and a dispersion liquid of the group Gb of rutile type titanium oxide particles are prepared. This step preferably includes a step of preparing a dispersion liquid of resin particles and a step of preparing a dispersion liquid of colorant particles as follows.

(1-1) Step of Preparing a Dispersion Liquid of Resin Particles

In this step, polymerizable monomers are put into an aqueous medium and polymerized to form binder resin particles (hereinafter also simply referred to as "resin particles") having a diameter of about 120 nm. Resin particles containing wax can be also formed. Resin particles containing wax can be prepared by dissolving or dispersing wax in the polymerizable monomers, followed by polymerization in an aqueous medium.

(1-2) Step of Preparing a Dispersion Liquid of Colorant Particles

Step of preparing a dispersion liquid of colorant particles includes preparing dispersion liquids of colorant particles by dispersing the group Ga of rutile type titanium oxide particles and the group Gb of rutile type titanium oxide particles (hereinafter, they are also collectively referred to as "colorant") into an aqueous medium in the form of fine particles. For the purpose of improving dispersion stability, a surfactant or a dispersion stabilizer may be added.

The above-described dispersion of the colorant/releasing agent can be performed by means of mechanical energy. The disperser is not particularly limited, and examples of dispersers include homogenizers, low-speed shearing dispersers, high-speed shearing dispersers, friction dispersers, high-pressure jet dispersers, ultrasonic dispersers, high-pressure impact dispersers (Altimizer), emulsion dispersers, and the like.

Dispersion stabilizers known in the art can be used. For example, dispersion stabilizers such as tricalcium phosphate are soluble in acids or alkalis and preferably used. In terms of environmental issues, enzymatically degradable dispersion stabilizers are preferably used.

Examples of surfactants that can be used include anionic surfactants, cationic surfactants, nonionic surfactants and ampholytic surfactants known in the art. The dispersion diameter can be measured, for example, by dynamic light scattering with a "MICROTRAC UPA-150" (Nikkiso Co., Ltd.). The dispersion is preferably performed until the dispersion diameter reaches the primary diameter of the titanium oxide particle. It is determined that the dispersion diameter have reached the primary diameter when the dispersion diameter measured during dispersion by dynamic light scattering becomes constant.

(2) Step of Aggregating and Fusing Resin Particles

In the step of aggregating and fusing resin particles, the binder resin, the group Ga of rutile type titanium oxide particles, and the group Gb of rutile type titanium oxide particles are aggregated and fused.

More specifically, the step includes aggregating the resin particles and colorant particles (rutile type titanium oxide particles) in an aqueous medium, and obtaining particles by fusing these aggregated particles. In this step, an aggregation agent such as alkali metal salt or alkaline earth metal salt is added to the aqueous medium, in which resin particles and colorant particles are present. Subsequently, aggregation process is performed by heating the dispersion at a temperature that is equal to or greater than the glass transition point of the resin particles and equal to or greater than the melting peak temperature (° C.) of the mixture. At the same time, process of fusing the resin particles with each other is performed. Preferably, the resin particles and the colorant particles prepared in the previous steps are added to the reaction system and the aggregation agent such as magnesium chloride is added thereto, so that particles are formed by performing the aggregation process of the resin particles and the colorant particles while the fusion process of the particles is performed at the same time. When the particle size reaches the target size, salts such as saline is added to stop aggregation.

(3) Aging Step

Subsequent to the above step of aggregating and fusing resin particles, in the aging step, the reaction system is heated until the particles are aged to have the desired average circularity.

(4) Cooling Step

In the cooling step, the dispersion liquid of the particles is cooled at the cooling rate of 1 to 20° C./min. The cooling method is not particularly limited. For example, the dispersion is cooled by circulating a coolant from the outside of the reaction vessel, or by adding cold water directly to the reaction system.

(5) Washing Step

The washing step includes the following steps; a solid-liquid separation step to separate the particles from the particle dispersion liquid cooled to a predetermined temperature in the above cooling step; and a washing step to clean the solid-liquid separated particles formed into a wet cake-like assembly by removing adhered substances such as a surfactant and an aggregation agent.

In the washing step, the particles are washed with water until the electrical conductivity of the filtrate reaches a level of 10 μS/cm. The filtration method is not particularly limited, and examples of methods include centrifugation, reduced pressure filtration with a Nutsche, filtration with a filter press, and the like.

(6) Drying Step

In the drying step, the washed particles are subjected to a drying process to obtain dried particles. Dryers that can be used in the drying step include dryers known in the art such as spray dryers, vacuum freeze dryers, reduced pressure dryers, fixed rack dryers, movable rack dryers, fluidized-bed dryers, rolling dryers and stirring dryers, and the like.

The water content of the dried particles is preferably equal to or less than 5 mass %, more preferably equal to or less than 2 mass %. When the dried particles are aggregated by weak interparticle force, they may be subjected to a cracking process. Cracking machines that can be used for this purpose include mechanical cracking machines such as jet mills, Henschel mixers, coffee mills and food processors.

(7) Step of Treating with External Additive

Toner particles are prepared by mixing the external additive to the dried particles in the step. The external additive may be added by using mechanical mixing machines such as a Henschel mixer or a coffee mill.

The materials (binder resin, releasing agents, etc.) used for preparing the above toner particles are described above.

<<Image Forming Apparatus>>

Figure 2:
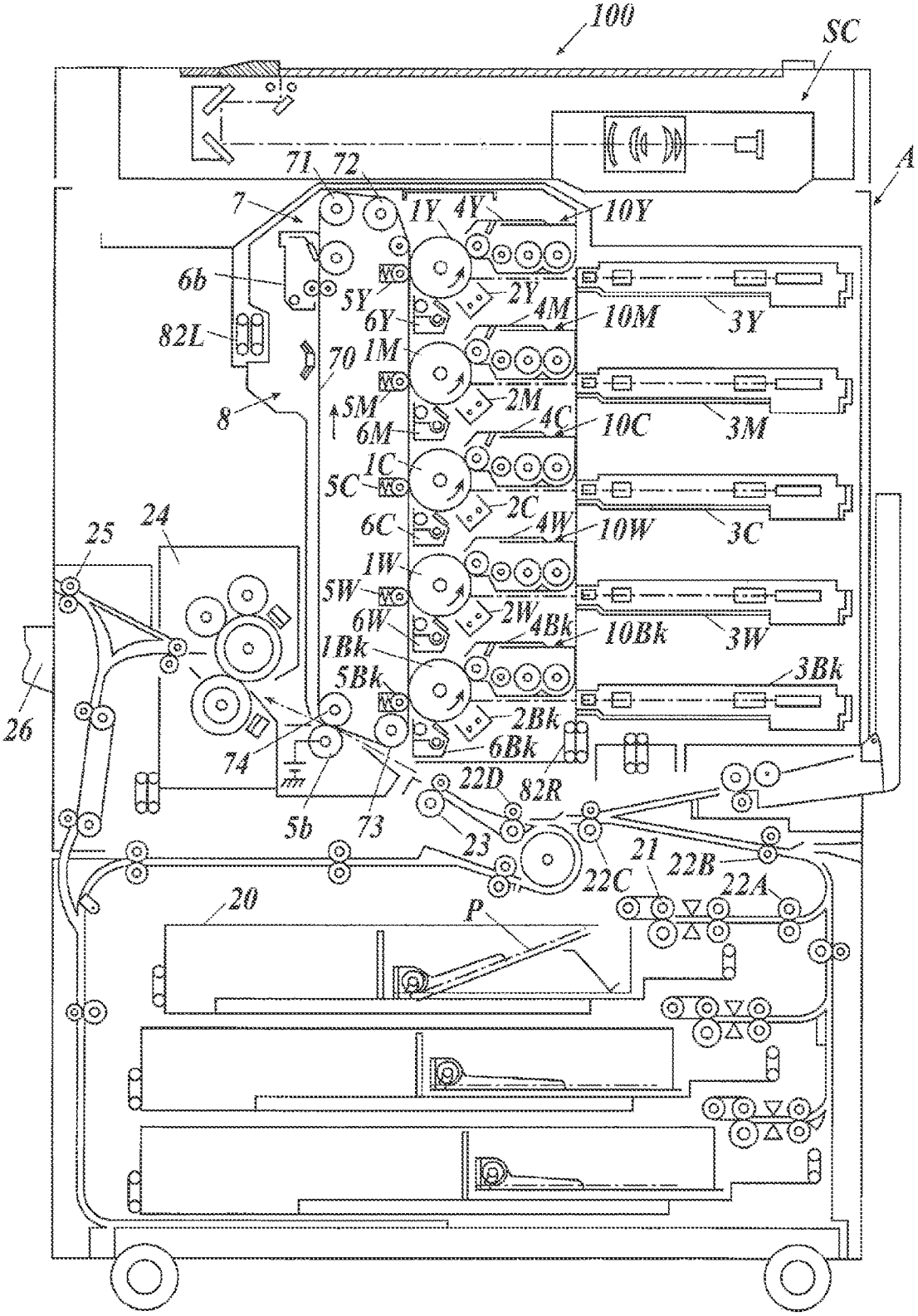
FIG. 2 is a schematic cross section diagram of an exemplary image forming apparatus according to the present invention.

FIG. 2 is a schematic cross section diagram of an exemplary image forming apparatus in which the toner according to the present invention can be used. The image forming apparatus according to the present invention includes a charger, an electrostatic charge image former, a developer, a transferring unit, and a fixer. The developer preferably forms a toner image by developing an electrostatic charge image using a developing agent for electrostatic charge image development including the electrostatic charge image developing white toner according to the present invention.

Furthermore, the image forming apparatus according to the present invention preferably includes five or more electrostatic charge image formers and five or more developers. Specifically, the image forming apparatus preferably includes five electrostatic charge image formers and five developers, respectively corresponding to white, cyan, magenta, yellow, and black, for example. A full color image can be thereby formed with white color having hiding property, hue, and transfer property that comply with the demand in the market of production printing.

The image forming apparatus 100 is a so-called tandem type color image forming apparatus and includes five image forming units 10W, 10Y, 10M, 10C, and 10Bk, an endless belt intermediate transferring unit 7, sheet feeding unit 21, and a fixer 24. A document scanner SC is disposed above a body A of the image forming apparatus 100.

The image forming unit 10W for forming a white image includes a charger 2W, an exposing unit 3W, a developer 4W, a first transferring roller 5W as a first transferring unit, and a cleaning unit 6W, which are disposed around a drum photoreceptor 1W.

The image forming unit 10Y for forming a yellow image includes a charger 2Y, an exposing unit 3Y, a developer 4Y, a first transferring roller 5Y as a first transferring unit, and a cleaning unit 6Y, which are disposed around a drum photoreceptor 1Y.

The image forming unit 10M for forming a magenta image includes a charger 2M, an exposing unit 3M, a developer 4M, a first transferring roller 5M as a first transferring unit, and a cleaning unit 6M, which are disposed around a drum photoreceptor 1M.

The image forming unit 10C for forming a cyan image includes a charger 2C, an exposing unit 3C, a developer 4C, a first transferring roller 5C as a first transferring unit, and a cleaning unit 6C, which are disposed around a drum photoreceptor 1C.

The image forming unit 10Bk for forming a magenta image includes a charger 2Bk, an exposing unit 3Bk, a developer 4Bk, a first transferring roller 5Bk as a first transferring unit, and a cleaning unit 6Bk, which are disposed around a drum photoreceptor 1Bk.

The five image forming units 10W, 10Y, 10M, 10C, and 10Bk respectively include the photoreceptors 1W, 1Y, 1M, 1C, and 1Bk at the center, the charger 2W 2Y, 2M, 2C, and 2Bk, the exposing units 3W, 3Y, 3M, 3C, and 3Bk, the rotary developer 4W, 4Y, 4M, 4C, and 4Bk, and the cleaning units 6W, 6Y, 6M, 6C, and 6Bk for cleaning the photoreceptors 1W, 1Y, 1M, 1C, and 1Bk.

The image forming units 10W, 10Y, 10M, 10C, and 10Bk have the same configuration except for the colors of toner images formed on the photoreceptors 1W, 1Y, 1M, 1C, and 1Bk. Thus, the following description focuses on the image forming unit 10W.

The image forming unit 10W includes the charger 2W, the exposing unit 3W, the developer 4W, and the cleaning unit 6W, which are disposed around the photoreceptor 1W (image retainer). The image forming unit 10W forms a white (W) toner image on the photoreceptor 1W. In the present embodiment, at least the photoreceptor 1W, the charger 2W, the developer 4W, and the cleaning unit 6W are integrated in the image forming unit 10W.

The charger 2W applies a uniform potential to the photoreceptor 1W. In the present invention, the charger is of, for example, a contact or contactless roller charging type.

The exposing unit 3W exposes the photoreceptor 1W provided with the uniform potential by the charger 2W in response to image signals (white) to form an electrostatic latent image corresponding to the white image. The exposure 3W includes light emitting elements (LEDs) arrayed in the axial direction of the photoreceptor 1W and an imaging element, or includes a laser optical system.

The developer 4W is composed of a developing sleeve that includes, for example, a built-in magnet and rotates while retaining a developing agent, and a voltage-applying device that applies a DC and/or AC bias voltage between the developing sleeve and the photoreceptor. In particular, the developer 4W preferably forms a toner image by developing an electrostatic charge image using a developing agent for electrostatic charge image development including the electrostatic charge image developing white toner according to the present invention The fixer 24 is of, for example, a heat roller fixing type that is composed of a heating roller including a heat source therein and a pressurizing roller disposed in a state being pressed to the heating roller so as to form a fixing nip portion.

The cleaning unit 6W is composed of a cleaning blade and a brush roller disposed upstream of the cleaning blade.

The aforementioned components, including the photoreceptor, the developer, and the cleaning unit, may be integrated into a processing cartridge (image forming unit) that is detachably provided on the body of the image forming apparatus 100. Alternatively, the photoreceptor and at least one of the charger, the exposing unit, the developer, the transferring unit, and the cleaning unit may be integrally supported to form a single processing cartridge (image forming unit) that is detachably provided on the apparatus body with a guiding unit, such as a rail in the apparatus body.

The endless-belt intermediate transferring unit 7 includes an endless intermediate transferring belt 70 (a semiconductive endless belt as a second image retainer) wound around and rotatably supported by multiple rollers.

The color images formed by the image forming units 10W, 10Y, 10M, 10C, and 10Bk are sequentially transferred onto the rotating intermediate transferring belt 70 with the respective first transferring rollers 5W, 5Y, 5M, 5C, and 5Bk (first transferring units), to form a synthesized color image. A transfer medium P (an image retainer to retain a fixed final image; e.g., a plain paper or a transparent sheet) accommodated in a sheet feeding cassette 20 is fed by the sheet feeding unit 21, and is transported to a second transferring roller 5*b* (second transferring unit) via multiple intermediate rollers 22A, 22B, 22C, and 22D and register rollers 23. The color image on the intermediate transferring belt 70 is transferred at once onto the transfer medium P in a second transferring operation. The color image transferred on the transfer medium P is fixed by the fixer 24. The transfer medium P is then pinched between discharging rollers 25 and is conveyed to a sheet receiving tray 26 provided outside of the apparatus. The image retainers for retaining a toner image transferred from the photoreceptor, such as the intermediate transferring belt and the transfer medium, are collectively called transferring media.

After the transfer of the color image onto the transfer medium P with the second transferring roller 5*b* (second transferring unit) and the curvature separation of the transfer medium P from the endless intermediate transferring belt 70, the residual toner on the intermediate transferring belt 70 is removed by the cleaning unit 6*b*.

The first transferring roller 5Bk abuts the photoreceptor 1Bk all the time during the image formation. The first transferring rollers 5W, 5Y, 5M, and 5C abut the respective photoreceptors 1W, 1Y, 1M, and 1C only during the formation of a color image.

The second transferring roller 5*b* abuts the intermediate transferring belt 70 only during passage of the transfer medium P therebetween for the second transferring operation.

A housing 8 can be drawn along supporting rails 82L and 82R from the apparatus body A.

The housing 8 accommodates the image forming units 10W, 10Y, 10M, 10C, and 10Bk, and the endless belt intermediate transferring unit 7.

The image forming units 10W, 10Y, 10M, 10C, and 10Bk are aligned in the vertical direction. The endless belt intermediate transferring unit 7 is disposed on the left of the photoreceptors 1W, 1Y, 1M, 1C, and 1Bk in FIG. 2. The endless belt intermediate transferring unit 7 includes the intermediate transferring belt 70 rotatably wound around rollers 71, 72, 73, and 74, the first transferring rollers 5W, 5Y, 5M, 5C, and 5Bk, and the cleaning unit 6*b*.

Although the image forming apparatus 100 illustrated in FIG. 2 is a color laser printer, the photoreceptor of the present invention can also be applied to monochrome laser printers and copiers. The exposure light source may be a light source other than a laser, such as an LED light source.

As described above, the image forming apparatus 100 according to the present invention includes five or more electrostatic charge image formers and five or more developers. A full color image can be thereby formed with white color having excellent hiding property, hue, and transfer property that comply with the demand in the market of production printing.

<<Image Forming Method>>

The image forming method includes a step of forming a latent image, a developing step, a transfer step, and a fixing step. The image forming method preferably uses the electrostatic charge image developing white toner according to the present invention and an electrostatic charge image developing colored toner including colorant exhibiting a color other than white. An image having hiding property, hue, and transfer property that comply with the demand in the market of production printing can be thereby provided.

The image forming method may further include a charging step and a cleaning step.

[Electrostatic Charge Image Developing Colored Toner Including Colorant Exhibiting a Color Other than White]

The electrostatic charge image developing colored toner including colorant exhibiting a color other than white is not particularly limited. Any known toner can be used, for example, a toner including general colorant.

[Charging Step]

The photoreceptor (electrophotographic photoreceptor) is charged in the charging step. A method for charging is not particularly limited. For example, the above-described charger can be preferably used.

[Step of Forming Latent Image]

In this step, an electrostatic latent image is formed on the electrophotographic photoreceptor (a support of an electrostatic latent image).

An electrophotographic photoreceptor is not particularly limited. For example, a drum type photoreceptor composed of an organic photoreceptor such as polysilane and phthalopolymethine may be used.

The electrostatic latent image is formed by uniformly charging the surface of the electrophotographic photoreceptor; and then, exposing imagewise the surface of the electrophotographic photoreceptor by the exposure.

The exposure is not particularly limited and the above described exposure can be used.

[Developing Step]

In a developing step, the electrostatic latent image is developed using a dry developing agent containing the toner according to the present invention and a toner image is thereby formed.

The toner image is formed, for example, in the above developer using a dry developing agent containing the toner according to the present invention.

Specifically, in the developer, the toner and the carrier are stirred to be mixed. During that time, the toner is charged by friction. The toner is retained on the surface of the rotating magnet roller to form a magnetic brush. Since the magnet roller is arranged in the vicinity of the electrophotographic photoreceptor, a part of toner constituting the magnetic brush formed on the surface of the magnet roller moves to the surface of the photoreceptor by the electric attraction. As a result, the electrostatic latent image is developed by the toner to form a toner image on the surface of the photoreceptor.

[Transferring Step]

In this step, the toner image is transferred to an image support.

The toner image is transferred to the image support by peeling and charging the toner image to the image support.

Examples of transferring unit include a corona transferring device with a corona discharge; a transfer belt; and a transfer roller.

An intermediate transfer member may be used in the transferring step as follows. For example, a toner image is first-transferred to an intermediate transfer member, and then, this toner image is secondly-transferred to an image support. Otherwise, the toner image formed on the electrophotographic photoreceptor may be directly transferred to the image support.

The image support is not particularly limited. Examples of the image support include a various materials such as plain paper from thin paper to thick paper, high quality paper, coated printing paper such as art paper and coat paper, commercially available Japanese paper and post card paper, plastic film for OHP, cloth, and the like

[Fixing Step]

In the fixing step, the toner image transferred on the image support is fixed on the image support. The fixing method is not limited in particular but may be include the above known fixer, for example, a heat roller fixing type composed of a heating roller including a heat source therein and a pressurizing roller disposed in a state being pressed to the heating roller so as to form a fixing nip portion.

[Cleaning Step]

The liquid developing agent which is not used for image formation is remained on a developing agent support member such as the developing roller, the photoreceptor, and the intermediate transfer member. In the cleaning step, the remained liquid developing agent is removed from the developing agent support member.

A cleaning method is not limited in particular. A preferable method includes using a blade that rubs the surface of the photoreceptor by locating at the position from which the edge portion of the blade abuts the photoreceptor. For example, the above-described cleaning units can be used.

The applicable embodiments of the present invention are not limited to the embodiments described-above. They may be suitably changed within the scope of not exceeding the object of the present invention.

EXAMPLES

Hereinafter, specific examples of the present invention will be described by referring to specific examples, but the present invention is not limited thereto. In the examples, the description of "parts" or "%" represents "mass parts" or "mass %" unless specific notice is given.

[Manufacturing Method of Rutile Type Titanium Oxide Particles T-1 to T-13]

Hereinafter, manufacturing method of rutile type titanium oxide particles T-1 to T-13 is described. Unless otherwise noted, a "group of rutile type titanium oxide" and "rutile type titanium oxide particles" are not distinguished from each other and they are collectively referred to as "rutile type titanium oxide particles" through the following description.

<Manufacturing Method of Rutile Type Titanium Oxide Particles T-1>

Ilmenite ores including 55 mass % of $TiO_2$ was used as a starting material. After drying at 150° C. for 2 hours, sulfuric acid was added to dissolve the material to obtain an aqueous solution of $TiOSO_4$. The aqueous solution of $TiOSO_4$ was concentrated and of a titania sol (6.0 parts by mass) including rutile crystal was added as crystal nuclei. After hydrolysis at 130° C., slurry of $TiO(OH)_2$ including impurities was obtained. The slurry was washed with water repeatedly at pH 5 to 6 (solution temperature: 25° C.) to remove sulfuric acid, $FeSO_4$, and the impurities. A meta-titanic acid ($TiO(OH)_2$) slurry of high purity was thereby obtained. The slurry was filtered, calcined at 180° C. for 10 hours, and crushed with a jet mill until there is no aggregation of fine particles. Rutile type titanium oxide fine particles having a volume average primary particle diameter (hereinafter, also simply referred to as "average diameter") of 233 nm was thereby obtained. (The diameters at the peak top position were the same as the volume average primary particle diameters in rutile type titanium oxide particles T-1 to T-13 and anatase type titanium oxide particles T-14.)

<Step of Dispersing Rutile Type Titanium Oxide Particles T-1>

Rutile type titanium oxide particles T-1 (210 parts by mass) was placed into an aqueous solution of a surfactant (sodium alkyl diphenyl ether disulfonate (1 mass %) in deionized water (482 parts by mass)) and was dispersed with a beads mill (beads diameter: 0.1 mm) to prepare a dispersion liquid T-1A of white colorant fine particles, in which white colorant fine particles are dispersed in an aqueous medium. The solid content was adjusted to 30 mass %.

Dispersion treatment was performed until the dispersion diameter measured by dynamic light scattering becomes constant. The average dispersion diameter was 233 nm.

<Step of Manufacturing and Dispersing Rutile Type Titanium Oxide Particles T-2>

Rutile type titanium oxide particles T-2 were prepared as in the rutile type titanium oxide particles T-1, except that a titania sol (2.5 parts by mass) including rutile crystal was added as crystal nuclei. Rutile type titanium oxide fine particles having an average diameter of 105 nm was thereby obtained. As in the rutile type titanium oxide particles T-1, dispersion treatment was performed until the dispersion diameter reaches the primary diameter of the titanium oxide particle diameter. The average dispersion diameter was 105 nm.

<Step of Manufacturing and Dispersing Rutile Type Titanium Oxide Particles T-3>

Rutile type titanium oxide particles T-3 were prepared as in the rutile type titanium oxide particles T-1, except that a titania sol (11.5 parts by mass) including rutile crystal was added as crystal nuclei. Rutile type titanium oxide fine particles having an average diameter of 430 nm was thereby obtained. As in the rutile type titanium oxide particles T-1, dispersion treatment was performed until the dispersion diameter reaches the primary diameter of the titanium oxide particle diameter. The average dispersion diameter was 430 nm.

<Step of Manufacturing and Dispersing Rutile Type Titanium Oxide Particles T-4>

Rutile type titanium oxide particles T-4 were prepared as in the rutile type titanium oxide particles T-1, except that a titania sol (8.0 parts by mass) including rutile crystal was added as crystal nuclei. Rutile type titanium oxide fine particles having an average diameter of 304 nm was thereby obtained. As in the rutile type titanium oxide particles T-1, dispersion treatment was performed until the dispersion diameter reaches the primary diameter of the titanium oxide particle diameter. The average dispersion diameter was 304 nm.

<Step of Manufacturing and Dispersing Rutile Type Titanium Oxide Particles T-5>

Rutile type titanium oxide particles T-5 were prepared as in the rutile type titanium oxide particles T-1, except that a titania sol (7.6 parts by mass) including rutile crystal was added as crystal nuclei. Rutile type titanium oxide fine particles having an average diameter of 295 nm was thereby obtained. As in the rutile type titanium oxide particles T-1, dispersion treatment was performed until the dispersion diameter reaches the primary diameter of the titanium oxide particle diameter. The average dispersion diameter was 295 nm.

<Step of Manufacturing and Dispersing Rutile Type Titanium Oxide Particles T-6>

Rutile type titanium oxide particles T-6 were prepared as in the rutile type titanium oxide particles T-1, except that a titania sol (6.4 parts by mass) including rutile crystal was added as crystal nuclei. Rutile type titanium oxide fine particles having an average diameter of 255 nm was thereby obtained. As in the rutile type titanium oxide particles T-1, dispersion treatment was performed until the dispersion diameter reaches the primary diameter of the titanium oxide particle diameter. The average dispersion diameter was 255 nm.

<Step of Manufacturing and Dispersing Rutile Type Titanium Oxide Particles T-7>

Rutile type titanium oxide particles T-7 were prepared as in the rutile type titanium oxide particles T-1, except that a titania sol (2.3 parts by mass) including rutile crystal was added as crystal nuclei. Rutile type titanium oxide fine particles having an average diameter of 96 nm was thereby obtained. As in the rutile type titanium oxide particles T-1, dispersion treatment was performed until the dispersion diameter reaches the primary diameter of the titanium oxide particle diameter. The average dispersion diameter was 96 nm.

<Step of Manufacturing and Dispersing Rutile Type Titanium Oxide Particles T-8>

Rutile type titanium oxide particles T-8 were prepared as in the rutile type titanium oxide particles T-1, except that a titania sol (12.0 parts by mass) including rutile crystal was added as crystal nuclei. Rutile type titanium oxide fine particles having an average diameter of 450 nm was thereby obtained. As in the rutile type titanium oxide particles T-1, dispersion treatment was performed until the dispersion diameter reaches the primary diameter of the titanium oxide particle diameter. The average dispersion diameter was 450 nm.

<Step of Manufacturing and Dispersing Rutile Type Titanium Oxide Particles T-9>

Rutile type titanium oxide particles T-9 were prepared as in the rutile type titanium oxide particles T-1, except that a titania sol (4.5 parts by mass) including rutile crystal was added as crystal nuclei. Rutile type titanium oxide fine particles having an average diameter of 180 nm was thereby obtained. As in the rutile type titanium oxide particles T-1, dispersion treatment was performed until the dispersion diameter reaches the primary diameter of the titanium oxide particle diameter. The average dispersion diameter was 180 nm.

<Step of Manufacturing and Dispersing Rutile Type Titanium Oxide Particles T-10>

Rutile type titanium oxide particles T-10 were prepared as in the rutile type titanium oxide particles T-1, except that a titania sol (13.0 parts by mass) including rutile crystal was added as crystal nuclei. Rutile type titanium oxide fine particles having an average diameter of 500 nm was thereby obtained. As in the rutile type titanium oxide particles T-1, dispersion treatment was performed until the dispersion diameter reaches the primary diameter of the titanium oxide particle diameter. The average dispersion diameter was 500 nm.

<Step of Manufacturing and Dispersing Rutile Type Titanium Oxide Particles T-11>

Rutile type titanium oxide particles T-11 were prepared as in the rutile type titanium oxide particles T-1, except that a titania sol (3.2 parts by mass) including rutile crystal was added as crystal nuclei. Rutile type titanium oxide fine particles having an average diameter of 130 nm was thereby obtained. As in the rutile type titanium oxide particles T-1, dispersion treatment was performed until the dispersion diameter reaches the primary diameter of the titanium oxide particle diameter. The average dispersion diameter was 130 nm.

<Step of Manufacturing and Dispersing Rutile Type Titanium Oxide Particles T-12>

Rutile type titanium oxide particles T-12 were prepared as in the rutile type titanium oxide particles T-1, except that a titania sol (4.1 parts by mass) including rutile crystal was added as crystal nuclei. Rutile type titanium oxide fine particles having an average diameter of 163 nm was thereby obtained. As in the rutile type titanium oxide particles T-1, dispersion treatment was performed until the dispersion diameter reaches the primary diameter of the titanium oxide particle diameter. The average dispersion diameter was 163 nm.

<Step of Manufacturing and Dispersing Rutile Type Titanium Oxide Particles T-13>

Rutile type titanium oxide particles T-13 were prepared as in the rutile type titanium oxide particles T-1, except that a titania sol (13.6 parts by mass) including rutile crystal was added as crystal nuclei. Rutile type titanium oxide fine particles having an average diameter of 522 am was thereby obtained. As in the rutile type titanium oxide particles T-1, dispersion treatment was performed until the dispersion diameter reaches the primary diameter of the titanium oxide particle diameter. The average dispersion diameter was 522 nm.

[Step of Manufacturing and Dispersing Anatase Type Titanium Oxide Particles T-14]

Anatase type titanium oxide particles T-14 were prepared as in the rutile type titanium oxide particles T-1, except that a titania sol (6.0 parts by mass) including anatase crystal was added as crystal nuclei. Rutile type titanium oxide fine particles having an average diameter of 233 nm was thereby obtained. As in the rutile type titanium oxide particles T-1, dispersion treatment was performed until the dispersion diameter reaches the primary diameter of the titanium oxide particle diameter. The average dispersion diameter was 233 nm.

<Measurement Method of Volume Average Primary Particle Diameter of Titanium Oxide Fine Particles>

For each of the groups of rutile type titanium oxide particles T-1 to T-13 and anatase type titanium oxide particles T-14, a volume particle size distribution curve was prepared on the basis of the primary diameter of randomly-selected 100 particles measured with a transmission type electron microscope "JEM-2000FX" (manufactured by JEOL). The particle diameter and the volume ratio were represented on a horizontal axis and on a vertical axis, respectively. The diameter of the peak-lop position of the volume particle size distribution curve was determined as the diameter of the peak-top position of the groups of rutile type titanium oxide particles T-1 to T-13 and anatase type titanium oxide particles T-14.

The conditions of accelerating voltage etc. were as follows.

Accelerating voltage: 80 kV, Magnification: 50000 times

<Measurement Method of Volume Average Particle Diameter of Titanium Oxide Dispersion Liquid>

The volume average particle diameter of the titanium oxide fine particles in the dispersion liquid was measured with a particle size distribution measuring device ("NANOTRAC UPA-EX 150" manufactured by NIKKISO CO., LTD). The value of d50 was determined as an average particle diameter.

[Preparation of Toner 1 to 17]

<Manufacturing of Toner 1>

(Preparation of Resin-Particle Dispersion Liquid A)

(1) First Polymerization

An surfactant solution of sodium n-dodecylsulfate (8 parts by mass) dissolved in deionized water (3000 parts by mass) was prepared in a reaction vessel equipped with a stirrer, a temperature sensor, a cooling tube, and a nitrogen inlet, and the reactor was heated to an inner temperature of 80° C. while the solution was stirred under a nitrogen stream at a stirring rate of 230 rpm. After heating, a solution of potassium persulfate (KPS) (10 parts by mass) dissolved in deionized water (200 parts by mass) was added to the above surfactant solution, and the internal temperature was controlled to be 80° C. Subsequently, a mixed solution of polymerizable monomers including the following compounds was added dropwise over one hour:

| | |
|---|---|
| Styrene | 480 parts by mass |
| n-butyl acrylate | 250 parts by mass |
| Methacrylic acid | 68 parts by mass |
| n-octyl-3-mercaptopropionate | 16 parts by mass |

After completion of the addition, the system was heated at 80° C. for two hours with stirring to perform polymerization (first polymerization). A "resin-particle dispersion liquid 1h" including "resin particles 1h" was thereby prepared.

(2) Second Polymerization

The following monomers and paraffin wax were placed into a flask equipped with a stirrer, and the wax was dissolved by heating to 90° C. to prepare a monomer solution.

Meanwhile, a surfactant solution including sodium polyoxyethylene-2-dodecyl ether sulfate (7 parts by mass) dissolved in deionized water (800 parts by mass) was heated to 98° C. The "resin particles 1h" (260 parts by mass in terms of solid content) and the mixed solution of monomers were added to the surfactant solution.

| | |
|---|---|
| Styrene | 45 parts by mass |
| n-butyl acrylate | 120 parts by mass |
| n-octyl-3-mercaptopropionate | 1.5 parts by mass |
| Paraffin wax "HNP-51 (Nippon Seiro Co., Ltd.)" | 67 parts by mass |

Subsequently, a dispersion liquid including emulsified particles was prepared by mixing and dispersing treatment for one hour with a mechanical dispersing machine "Cleamix" (made by M Technique Co., Ltd.) having a circulating path.

Subsequently, a solution including potassium persulfate (6 parts by mass) dissolved in deionized water (200 parts by mass) was added to the dispersion. The system was heated at 82° C. for one hour with stirring to perform polymerization (second polymerization). A "resin-particle dispersion liquid 1HM" including "resin particles 1HM" was thereby prepared.

(3) Third Polymerization

An initiator aqueous solution of potassium persulfate (11 parts by mass) in deionized water (400 parts by mass) was added to the above "resin-particle dispersion liquid 1HM". After heating to 80° C., a mixed solution of polymerizable monomers including the following compounds was added dropwise over one hour:

| | |
|---|---|
| Styrene | 435 parts by mass |
| n-butyl acrylate | 130 parts by mass |
| Methacrylic acid | 33 parts by mass |
| n-octyl-3-mercaptopropionate | 8 parts by mass |

After completion of the addition, the solution was stirred with heating for two hours to perform polymerization (third polymerization). Subsequently, the solution was cooled to 28° C. to prepare "resin-particle dispersion liquid A". The volume-based median diameter of the particles measured with an electrophoretic light scattering photometer "ELS-800 (manufactured by Otsuka Electronics Co., Ltd.)" was 150 nm. The glass transition point measured by a known method was 45° C. The weight-average molecular weight of the resin was 32000.

(4) Preparation of "Toner Base Particles 1"

The following components were placed into a flask equipped with a stirrer, a temperature sensor, a cooling tube, and a nitrogen inlet.

| | |
|---|---|
| Resin-particle dispersion liquid A | 300 parts by mass (in terms of solid content) |
| Deionized water | 1400 parts by mass |

-continued

| | |
|---|---|
| Dispersion liquid of rutile type titanium oxide particles T-1 | 8.4 parts by mass (in terms of solid content) |
| Dispersion liquid of rutile type titanium oxide particles T-4 | 75.6 parts by mass (in terms of solid content) |

Furthermore, a solution including sodium polyoxyethylene-2-dodecyl sulfate (3 parts by mass) dissolved in deionized water (120 parts by mass) was added, the temperature of the mixture was adjusted to 30° C. A 5 mol/L aqueous sodium hydroxide solution was then added to the reactor to adjust the pH of the mixture to 10.

Subsequently, a solution of magnesium chloride hexahydrate (35 parts by mass) dissolved in deionized water (35 parts by mass) was added to the mixture with agitation at 30° C. over 10 minutes. The system was left to stand for three minutes, and then was heated over 60 minutes to 90° C. While the system was kept at 90° C., the aggregation and fusion of the particles was performed. In this state, the diameters of the particles growing in the reaction vessel were measured with "Multisizer 3" (made by Beckman Coulter, Inc.) When the volume-based median diameter reached 6.5 μm, an aqueous solution of sodium chloride (150 parts by mass) dissolved in deionized water (600 parts by mass) was added to terminate the growth of the particles. The system was further heated at 98° C. under stirring as an aging process to fuse the particles until the average circularity measured with an analyzer "FPIA-2100" (made by Sysmex Corporation) reached 0.965.

Next, the solution was cooled to 30° C., pH was adjusted to 2 using hydrochloric acid, and stirring was stopped.

The dispersion liquid of toner base particles prepared through the above steps was subjected to solid liquid separation with a basket type centrifugal separator "MARK III" (MODEL NUMBER 60×40) (manufactured by MATSUMOTO KIKAI MFG. CO., LTD.) to extract a "wet cake of the toner base particles".

The wet cake was washed with the basket type centrifugal separator using deionized water (45° C.) until the electrical conductivity of the filtrate reaches a level of 5 μS/cm. Subsequently, the wet cake was moved to an airflow type dryer "FLASH JET DRYER" (manufactured by SEISHIN ENTERPRISE CO., LTD.), and the drying process of the wet cake was performed until the water quantity thereof became 0.5 mass %. White "toner base particles 1" was thereby prepared.

(Preparation of Toner 1)

Silica (number average primary diameter: 30 nm, 2.0 parts by mass) treated with n-butyltrimethoxysilane was added to the toner base particles 1 (100 parts by mass) using Henschel mixer "FM10B" (NIPPON COKE & ENGINEERING CO., LTD.) for 20 minutes at 60 m/second of peripheral speed of agitation impeller, at 30° C. to add an external additive. After adding an external additive, coarse particles were removed using a sieve having an open mesh-size of 90 μm to prepare "Toner 1" with the above external additive.

<Manufacturing of Toners 2 to 8 and 10 to 17>

Toners 2 to 8 and 10 to 17 were prepared as in the manufacturing of Toner 1, except that the mass and the mass ratio of the two groups (Ga and Gb) of rutile type titanium oxide particles having different volume particle size distribution were changed as described in TABLE 1. The toner base particles have a constitution of resins similar to that of Toner 1.

TABLE 1

| Toner | Titanium oxide particle | | | | | | | | | |
|---|---|---|---|---|---|---|---|---|---|---|
| | Ga | | Gb | | Db − Da | Mass of Ga:Mass | Mass % to | | Manufacturing | |
| No. | No. | Da [nm] | No. | Db [nm] | [nm] | of Gb | binder resin | Toner resin | method of toner | Remarks |
| 1 | T-1 | 233 | T-4 | 304 | 71 | 10:90 | 28 | Vinyl resin | Polymerization | Present invention |
| 2 | T-2 | 105 | T-9 | 180 | 75 | 10:90 | 28 | Vinyl resin | Polymerization | Present invention |
| 3 | T-3 | 430 | T-10 | 500 | 70 | 10:90 | 28 | Vinyl resin | Polymerization | Present invention |
| 4 | T-2 | 105 | T-11 | 130 | 25 | 10:90 | 28 | Vinyl resin | Polymerization | Present invention |
| 5 | T-4 | 304 | T-10 | 500 | 196 | 10:90 | 28 | Vinyl resin | Polymerization | Present invention |
| 6 | T-1 | 233 | T-4 | 304 | 71 | 30:70 | 28 | Vinyl resin | Polymerization | Present invention |
| 7 | T-1 | 233 | T-4 | 304 | 71 | 5:95 | 28 | Vinyl resin | Polymerization | Present invention |
| 8 | T-1 | 233 | T-4 | 304 | 71 | 10:90 | 15 | Vinyl resin | Polymerization | Present invention |
| 9 | T-1 | 233 | T-4 | 304 | 71 | 10:90 | 65 | Polyester resin | Pulverization | Present invention |
| 10 | T-4 | 304 | — | — | 0 | — | 28 | Vinyl resin | Polymerization | Comparative example |
| 11 | T-1 | 233 | T-4 | 304 | 71 | 2:98 | 28 | Vinyl resin | Polymerization | Comparative example |
| 12 | T-1 | 233 | T-4 | 304 | 71 | 40:60 | 28 | Vinyl resin | Polymerization | Comparative example |
| 13 | T-5 | 295 | T-4 | 304 | 9 | 10:90 | 28 | Vinyl resin | Polymerization | Comparative example |
| 14 | T-6 | 255 | T-10 | 500 | 245 | 10:90 | 28 | Vinyl resin | Polymerization | Comparative example |
| 15 | T-7 | 96 | T-12 | 163 | 67 | 10:90 | 28 | Vinyl resin | Polymerization | Comparative example |
| 16 | T-8 | 450 | T-13 | 522 | 72 | 10:90 | 28 | Vinyl resin | Polymerization | Comparative example |
| 17 | T-14 | 233 | T-4 | 304 | 71 | 10:90 | 28 | Vinyl resin | Polymerization | Comparative example |
| | | (Anatase) | | | | | | Vinyl resin | Polymerization | Comparative example |

<Manufacturing of Toner 9>

(Synthesis of Amorphous Polyester Resin)

Terephthalic acid (TPA) (90 parts by mass), trimellitic acid (TMA) (6 parts by mass), fumaric acid (FA) (19 parts by mass), dodecenylsuccinic acid anhydride (DDSA) (85 parts by mass), Bisphenol A propylene oxide adduct (BPA•PO) (351 parts by mass), and Bisphenol A ethylene oxide adduct (BPA•EO) (58 parts by mass) were placed in a reaction vessel equipped with an agitator, a thermometer, a condenser and a nitrogen gas inlet, and the reaction vessel was purged with dried nitrogen gas. Titanium tetrabutoxide (0.1 parts by mass) was added, and the reaction system was stirred for 8 hours at 180° C. under a nitrogen gas stream for polymerization reaction. Titanium tetrabutoxide (0.2 parts by mass) was further added and the reaction system was stirred for 6 hours at 220° C. The reaction vessel was depressurized to 10 mmHg and the reaction was continued under the reduced pressure to prepare amorphous polyester resin having a weight-average molecular weight (Mw) of 17000.

Subsequently, the following components were kneaded at 120° C. in a biaxial extruder. After the kneading, the mixture was cooled to 25° C.

| | |
|---|---|
| Amorphous resin | 290 parts by mass |
| Fischer-Tropsch wax "FNP-0090" (releasing agent) | 10 parts by mass |
| Rutile type titanium oxide particles T-1 | 8.4 parts by mass |
| Dispersion liquid of rutile type titanium oxide particles T-4 | 75.6 parts by mass |

The mixture was preliminarily pulverized with a hammer mill, was roughly pulverized with a turbo mill (Freund-Turbo Corporation), and further finish-pulverized with an air classifier utilizing the Coanda effect. Toner 9 with a volume median diameter of 7.0 μm was thereby prepared.

(Evaluation Standard)

A: C* is 0 or more and less than 1.0

B: C* is 1.0 or more and less than 1.5

C: C* is more than 1.5

<Evaluation of Transfer Property>

The mass of toner on a developed photoreceptor and the mass of toner transferred on an intermediate transfer medium were evaluated. Transfer rate was calculated by the following equation.

Transfer rate (%)={(mass of toner transferred on intermediate transfer medium)/(mass of toner on developed photoreceptor)}×100

A: Transfer rate is 90% or more

B: Transfer rate is 80% or more and less than 90%

C: Transfer rate is less than 80%

TABLE 2

| Toner | Whiteness | | Hue | | Transfer rate | | |
|---|---|---|---|---|---|---|---|
| No. | L' value | Evaluation | C' | Evaluation | [%] | Evaluation | Remarks |
| 1 | 95 | A | 0.3 | A | 92 | A | Present invention |
| 2 | 84 | B | 0.2 | A | 90 | A | Present invention |
| 3 | 85 | B | 1.3 | B | 84 | B | Present invention |
| 4 | 81 | B | 0.4 | A | 90 | A | Present invention |
| 5 | 82 | B | 1.3 | B | 84 | B | Present invention |
| 6 | 88 | B | 0.4 | A | 90 | A | Present invention |
| 7 | 90 | A | 1.4 | B | 89 | B | Present invention |
| 8 | 80 | B | 0.2 | A | 97 | A | Present invention |
| 9 | 98 | A | 0.9 | A | 80 | B | Present invention |
| 10 | 68 | C | 1.9 | C | 82 | B | Comparative example |
| 11 | 72 | C | 1.7 | C | 78 | C | Comparative example |
| 12 | 71 | C | 1.2 | B | 80 | B | Comparative example |
| 13 | 77 | C | 1.8 | C | 83 | B | Comparative example |
| 14 | 70 | C | 1.4 | B | 75 | C | Comparative example |
| 15 | 60 | C | 0.4 | A | 89 | B | Comparative example |
| 16 | 64 | C | 2.1 | C | 70 | C | Comparative example |
| 17 | 59 | C | 0.3 | A | 95 | A | Comparative example |

[Preparation of Developing Agents 1 to 17 for Toners 1 to 17]

Developing agents 1 to 17 were prepared by mixing each of the toners 1 to 17 and a ferrite carrier such that a toner concentration became 5% by mass. The ferrite carrier was coated with a silicone resin and a volume average particle diameter thereof was 35 μm.

[Evaluation]

A commercial printer "bizhub PRESS C1070" (manufactured by KONICA MINOLTA, INC.), was used as a machine to output an image for evaluation. OHP film was used as medium on which the image for evaluation was formed. The image for the following evaluation was a solid image having a toner density of 4.0 g/m$^2$ (patch image of 4.0 cm×2.5 cm).

The evaluation result is shown in TABLE 2.

<Evaluation of Whiteness (Hiding Power)>

The color of the output image was measured with spectrophotometer "X-Rite 939" (manufactured by X-Rite, Inc.) in a CIE 1976 (L*A*B*) color system. The whiteness (hiding power) was evaluated from the obtained L* value in the CIE 1976 (L*A*B*) color system on the basis of the following criteria.

A: L* value is 95 or more

B: L* value is 80 or more and less than 95

C: L* value is less than 80

<Evaluation of Hue>

From the above-described image, saturation was calculated by the following equation and used as hue.

$$\text{Hue}(C^*)=\{(a^*)^2+(b^*)^2\}^{0.5}$$

(Summary)

It is clear from the above results that the present invention provides an electrostatic charge image developing white toner and the like, having hiding property, hue, and transferability complying with the demand in the market of production printing.

Although embodiments of the present invention have been described and illustrated in detail, it is clearly understood that the same is by way of illustration and example only and not limitation, the scope of the present invention should be interpreted by terms of the appended claims.

What is claimed is:

1. An electrostatic charge image developing white toner comprising toner base particles comprising rutile type titanium oxide particles as colorant and a binder resin, wherein the rutile type titanium oxide particles are composed of two groups Ga and Gb of rutile type titanium oxide particles having different volume particle size distribution, and a volume particle size distribution curve of the rutile type titanium oxide particles represents diameter on a horizontal axis and volume ratio on a vertical axis and has two main peaks, wherein diameters Da and Db of peak top positions of the two main peaks are respectively within a range of 100 to 500 nm, and satisfy following Relational expressions:

(Relational expression 1): $25\text{ nm} \leq Db-Da \leq 200\text{ nm}$ (Relational expression 2):(mass of $Ga$): (mass of $Gb$)=5:95 to 30:70.

2. The electrostatic charge image developing white toner according to claim 1, wherein total mass of the two groups Ga and Gb of rutile type titanium oxide particles are within a range of 20 to 60 mass % relative to 100 mass % of the binder resin.

3. The electrostatic charge image developing white toner according to claim 1, wherein the diameters Da and Db are respectively within a range of 200 to 300 nm.

4. The electrostatic charge image developing white toner according to claim 1, wherein the diameters Da and Db satisfy following Relational expression 3:

(Relational expression 3): $20\ \text{nm} \leq Db - Da \leq 100\ \text{nm}$.

5. The electrostatic charge image developing white toner according to claim 1, comprising a vinyl resin as the binder resin.

6. A manufacturing method to manufacture the electrostatic charge image developing white toner according to claim 1, comprising a step of preparing a dispersion liquid of the binder resin, a dispersion liquid of the group Ga of rutile type titanium oxide particles, and a dispersion liquid of the group Gb of rutile type titanium oxide particles; and a step of aggregating and fusing the binder resin, the group Ga of rutile type titanium oxide particles, and the group Gb of rutile type titanium oxide particles.

7. An image forming apparatus comprising a charger, an electrostatic charge image former, a developer, a transferring unit, and a fixer, wherein the developer forms a toner image by developing an electrostatic charge image using a developing agent for electrostatic charge image development comprising the electrostatic charge image developing white toner according to claim 1.

8. The image forming apparatus according to claim 7, comprising five or more electrostatic charge image formers and five or more developers.

9. An image forming method comprising forming a latent image, developing, transferring, and fixing;

using the electrostatic charge image developing white toner according to claim 1 and an electrostatic charge image developing colored toner comprising colorant exhibiting a color other than white.

* * * * *